US006371334B1

(12) United States Patent
Lombardi

(10) Patent No.: US 6,371,334 B1
(45) Date of Patent: Apr. 16, 2002

(54) MINIATURE PERFUME BOTTLE

(76) Inventor: Carl M. Lombardi, c/o Lombardi Design & Mfg., 100 Doxsee Rd., Freeport, NY (US) 11520-4716

( * ) Notice: Subject to any disclaimer, the term of this patent is extended or adjusted under 35 U.S.C. 154(b) by 0 days.

(21) Appl. No.: 09/613,369

(22) Filed: Jul. 10, 2000

(51) Int. Cl.[7] ..... B65D 23/00
(52) U.S. Cl. ..... 222/325; 222/78; 222/130
(58) Field of Search ..... 222/78, 130, 320, 222/325

(56) References Cited

U.S. PATENT DOCUMENTS

| | | | | |
|---|---|---|---|---|
| 1,741,154 A | | 12/1929 | Haigney | 215/12.1 |
| 2,093,905 A | | 9/1937 | Bowen | 215/12.1 |
| 2,113,848 A | | 4/1938 | Lui | 215/12.1 |
| 2,889,065 A | | 6/1959 | Lawlor | 215/12.1 |
| 3,900,121 A | | 8/1975 | Kruck | 215/12.1 |
| 3,942,667 A | | 3/1976 | Thomas | 215/12.1 |
| 4,371,087 A | | 2/1983 | Saujet | 215/12.1 |
| 4,733,807 A | | 3/1988 | Porter et al. | |
| 5,125,521 A | | 6/1992 | Somogyi | 215/12.1 |
| 5,197,602 A | | 3/1993 | Biesecker et al. | |
| 5,492,248 A | * | 2/1996 | Ortner | 222/78 |
| 5,507,401 A | | 4/1996 | Huang | 215/12.1 |
| 6,016,916 A | * | 1/2000 | Ortner | 222/325 |
| 6,186,348 B1 | * | 2/2001 | Rouet | 215/12.1 |

* cited by examiner

*Primary Examiner*—J. Casimer Jacyna
(74) *Attorney, Agent, or Firm*—Morgan, Lewis & Backius, LLP

(57) ABSTRACT

A device for use in a gift/sample box or for test marketing a perfume, such as to a focus group, includes a smaller or miniature version of a perfume bottle, a removable dispensing vial of perfume, and a top. Various bottle designs can be tested with different perfumes or the same perfume, because the perfume vial is removable from each test bottle. Similarly, the device can be used in a gift/sample pack, the miniature version of the bottle evoking the bottle design of a commercially available perfume which sales it is designed to improve, and having a smaller volume of perfume that a merely smaller version of the bottle in which the commercially available perfume is sold.

3 Claims, 1 Drawing Sheet

MINIATURE PERFUME BOTTLE

BACKGROUND OF THE INVENTION

1. Field of the Invention

This invention relates to a sample perfume bottle and perfume for test marketing the bottle and/or the perfume, and for gift packs for an existing perfume.

2. The State of the Art

Various perfumes are often test-marketed with respect to the perfume, the perfume bottle, and/or its packaging. Focus-groups are one method of testing, wherein a product is given to an independent group of people (for example, potential consumers or randomly chosen) whose comments on the potentially-marketed item are solicited for possible changes to be made to the item.

One aspect of perfume marketing is its packaging. There are various novel styles of packaging, as described, for example, in the following U.S. patents:

| | |
|---|---|
| Haigney | 1,741,154 |
| Bowen | 2,093,905 |
| Lui | 2,113,848 |
| Lawlor | 2,889,065 |
| Seaver | 3,102,650 |
| Wittwer | 3,868,036 |
| Kruck | 3,900,121 |
| Thomas | 3,942,667 |
| Saujet | 4,371,087 |
| Porter et al. | 4,733,807 |
| Somogyi | 5,125,521 |
| Biesecker et al. | 5,197,602 |
| Huang | 5,507,401 |

Most of these styles involve a decorative container for a bottle of perfume; for example, a cork container (Thomas), or a wood or metal container (Haighney), or one where the wood can be decoratively carved (Bowen), or a reusable decorative case made from crystal or precious metal-plated plastic (Somogyi). Others (Huang and Saujet) provide a housing for the glass perfume bottle.

Perfume bottles are often designed to have distinctive shapes, oftentimes trademarked, so that the marketer develops consumer awareness of the particular bottle associated with a given perfume. Occasionally, the marketer may change the fragrance of the perfume and maintain the bottle design, or may change the bottle, or both. Changing either the bottle, which is made of glass (unless a refill, as described by Somogyi), is often an expensive proposition, at least in part due to the cost of a production quantity of new molds. Changing the perfume is similarly costly and likely more time-consuming.

Accordingly, it is difficult to test market, such as a presentation to a focus group, a new perfume and/or perfume bottle. This invention provides an easier method for providing a sample perfume bottle for test-marketing perfume.

In another respect, one method for marketing a perfume includes providing a gift box or sample pack which includes a smaller (e.g., miniature) version of a commercially available perfume. For more unusual bottles, it is often not cost effective to provide a miniature version of the bottle, and so the miniature bottle provided is a standard rectilinear (circular or rectangular) bottle. Accordingly, in another aspect this invention provides a more cost effective method for providing miniature versions of commercially available perfumes for gift boxes and samples.

SUMMARY OF THE INVENTION

One object of this invention is to provide a relatively inexpensive test perfume bottle for marketing perfume, and especially one where the perfume is removable and can be placed into a test bottle of another design.

Another object of this invention is to provide a relatively inexpensive perfume bottle as a miniature (smaller) version of a commercially available perfume for use as a sample or as part of a gift box.

A device for accomplishing these objects comprises a two part container having a top and a bottom and the combined geometry and ornamental appearance of a perfume bottle, especially a smaller version of a commercial perfume bottle, and a bore or channel into which a removable dispensing canister of perfume can be housed.

DETAILED DESCRIPTION OF SPECIFIC EMBODIMENTS

Figure 1:
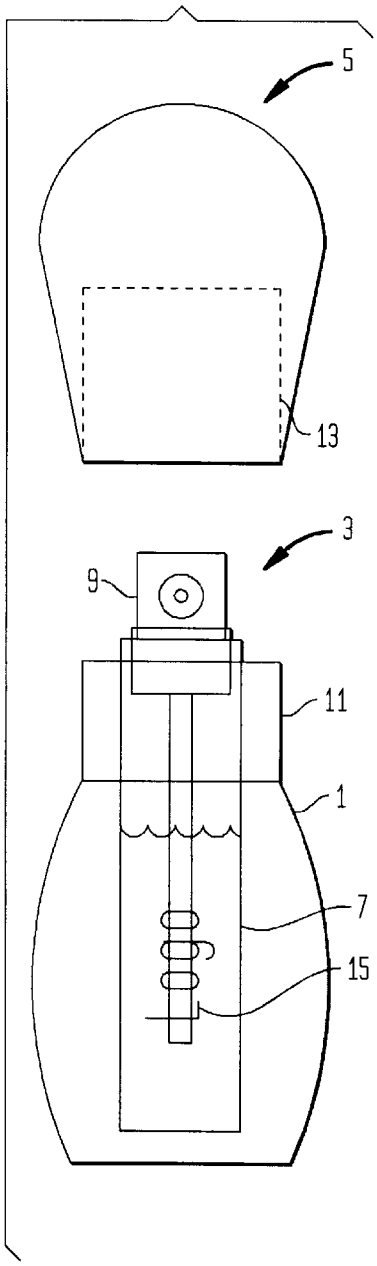
FIG. 1 depicts an idealized side view of the test bottle and replaceable top with a perfume sample dispensing canister.

FIG. 1 shows an idealized side view of the novel device. The test bottle 1 can be made of any material but is preferably polymeric, and especially one that is transparent or translucent to effect the simulation of a commercially available glass perfume bottle. Such material is preferably also able to be dyed into colors in which the glass for commercially available perfume bottles can be colored. Disposed in a channel or bore in the bottle 1 is a removable dispensing canister 3 for a perfume sample. Completing the simulation is a top or cap 5 for the test bottle. When the cap and bottle are joined together, the bottle has the appearance, and at least the outline and ornamental appearance, of a commercially available perfume bottle.

The removable dispensing canister in which the perfume is held comprises a container 7 in which the perfume sample (as shown by the fluid level line 8) is housed. The container is preferably clear, especially if the test bottle is clear or translucent, and is preferably glass, although polymers can be used. The container is preferably a right rectangular cylinder, although other geometries (e.g., right rectangular rhombus, triangle, or polygon) can be suitable if such a container fits the bore in the test bottle into which the container is inserted. Integral with the container is a dispensing cap, preferably a spring-loaded pump type device 9 having a sprayer or atomizer 10 for dispensing the perfume.

The top or cap is preferably made of the same (or type of) material of which the test bottle is made; for example, both may be plastics, but each may be a different type of plastic. In the embodiment shown, the test bottle had a collar 11 and the cap is opaque and has a corresponding hollow 13 that slides over the collar so that when the cap is placed on the test bottle the atomizing top of the dispensing container is hidden.

Figure 2A:
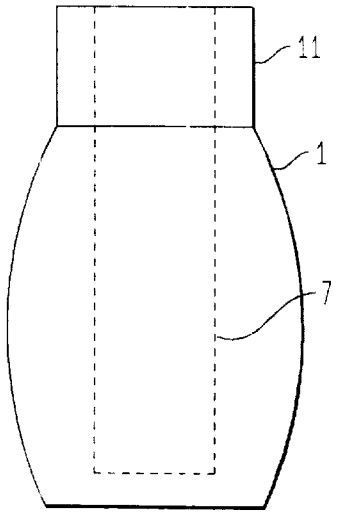
FIG. 2A is an idealized side view of the bottle alone.
Figure 2B:
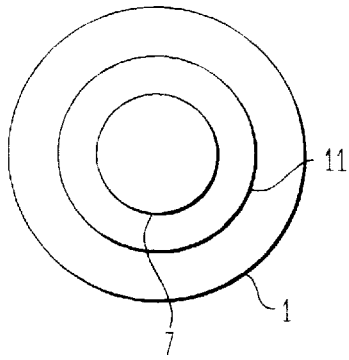
FIG. 2B is an idealized top view of the bottle in FIG. 2A.

FIG. 2A depicts a side view of the test bottle 1 in which there is a bore or channel 13 into which the removable dispensing canister is inserted. FIG. 2B depicts a top view of the bottle shown in FIG. 2A.

In one use, for example, a test bottle of a given geometry is provided with a canister having a desired perfume, assembled with the canister in the bore and the top on the bottle, and presented to a focus group. Depending on the comments elicited from the focus group, the group can be presented with the same perfume in a different bottle (or with a different top), a different perfume in the same bottle, or a completely new combination of bottle (and optionally top) and perfume. Additionally, the name of the perfume can be test-marketed, and the perfume identity tracked, by providing a product name or logo 15 (shown in FIG. 1) on the canister. In this way, the total combination of bottle and perfume can be altered to provide the most desirable combination.

As another use, a bottle according to this invention is provided in the same geometry as that of a commercially available bottle of perfume, and the dispensing canister is provided with the same perfume available commercially, thereby providing a miniature simulation of a commercially available product for use as a sample or in the fabrication of a gift/sample pack. Especially with a perfume having a well-known brand name and/or bottle geometry, a user finding such a bottle will have the recognition and appreciation for having received such a perfume, realizing that the article is only a miniature version. Further, providing a quantity of perfume sufficient to fill only a rectilinear dispensing vial, and not the entire volume of a small miniature bottle, provides added incentive for the receiver of such a gift/sample to purchase the perfume. Still further, because many commercially available perfumes are sold in rather small bottles, some of which may appear to be a miniature of the same brand sold in a larger size, a simple examination of the bottle presently supplied will distinguish it as a sample rather than a commercial volume of perfume.

The foregoing description is meant to be illustrative and not limiting. Various changes, modifications, and additions may become apparent to the skilled artisan upon a perusal of this specification, and such are meant to be within the scope and spirit of the invention as defined by the claims.

What is claimed is:

1. A perfume test marketing kit, comprising:

a. a miniature disposable perfume dispensing canister having
   i. a cylindrical container including an open top end and a sealed bottom end,
   ii. perfume in liquid form contained within said cylindrical container,
   iii. a dispensing cap including a spray or atomization nozzle, wherein said dispensing cap is attached to and closes said open top end of said cylindrical container so as to enclose said perfume, and
   iv. a pump for pumping said perfume from said cylindrical container to and out of said nozzle; and b. a plurality of minature test containers with various and different ornamental designs and or colors for test marketing said ornamental designs and colors together with said perfume, each having
   i. a first solid one piece base portion including a closed lower end, an open upper end, and a cylindrical bore between said closed lower end and said open upper end for snugly and removably receiving said cylindrical container, and
   ii. a second one piece cap portion adapted for snug and removable attachment to said open upper end of said first portion.

2. The perfume test marketing apparatus of claim 1, wherein said miniature disposable perfume dispensing canister further comprises a name or logo.

3. The perfume test marketing apparatus of claim 1, wherein said miniature test container further comprises a name or logo.

* * * * *